US008097844B2

(12) United States Patent
Furuhashi et al.

(10) Patent No.: US 8,097,844 B2
(45) Date of Patent: Jan. 17, 2012

(54) MASS-ANALYSIS METHOD AND MASS-ANALYSIS APPARATUS

(75) Inventors: Osamu Furuhashi, Uji (JP); Ding Li, Sale (GB)

(73) Assignee: Shimadzu Corporation, Kyoto (JP)

( * ) Notice: Subject to any disclaimer, the term of this patent is extended or adjusted under 35 U.S.C. 154(b) by 628 days.

(21) Appl. No.: 12/161,860

(22) PCT Filed: Feb. 23, 2006

(86) PCT No.: PCT/JP2006/303291

§ 371 (c)(1), (2), (4) Date: Jul. 23, 2008

(87) PCT Pub. No.: WO2007/096970

PCT Pub. Date: Aug. 30, 2007

(65) Prior Publication Data

US 2009/0032698 A1 Feb. 5, 2009

(51) Int. Cl.
*H01J 49/42* (2006.01)

(52) U.S. Cl. ..... 250/282; 250/281; 250/290; 250/291; 250/293

(58) Field of Classification Search ..... None
See application file for complete search history.

(56) References Cited

U.S. PATENT DOCUMENTS

| | | | | |
|---|---|---|---|---|
| 4,736,101 | A * | 4/1988 | Syka et al. | 250/292 |
| 5,386,113 | A * | 1/1995 | Franzen et al. | 250/292 |
| 5,528,031 | A * | 6/1996 | Franzen | 250/282 |
| 6,949,743 | B1 * | 9/2005 | Schwartz | 250/290 |
| 2003/0155507 | A1 * | 8/2003 | Hashimoto et al. | 250/292 |

(Continued)

FOREIGN PATENT DOCUMENTS

JP 2000-105220 A 4/2000

(Continued)

OTHER PUBLICATIONS

Li Ding, et al, "A Digital Ion Trap Mass Spectrometer Coupled With Atmospheric Pressure Ion Sources", Journal of Mass Spectrometry, 2004, pp. 471-484, vol. 39.

(Continued)

*Primary Examiner* — Robert Kim
*Assistant Examiner* — Michael Logie
(74) *Attorney, Agent, or Firm* — Sughrue Mion, PLLC

(57) ABSTRACT

Among various ions introduced into an ion trap 1, those ions which are within a predetermined mass range including the mass-to-charge ratio of an objective ion are selected. Then, the frequency of a capturing voltage is set so that the objective ion will be captured with a high q-value, and a CID gas is introduced into the ion trap 1. An excitation voltage corresponding to the mass-to-charge ratio of the objective ion is applied to end-cap electrodes 3 and 4 to cause an oscillation of the objective ion and help dissociation of the ion by CID. The high q-value leads to a high dissociation efficiency. The application of the excitation voltage is discontinued before the low-mass ions produced by CID totally dissipate. Simultaneously with this operation, or slightly delayed therefrom, the frequency of the capturing voltage is switched so that the q-value will be lowered. Although the high q-value allows the low-mass product ions to easily dissipate during the CID process, they can be captured within an ion-trapping space 5 since the q-value is lowered when those ions still remain there. Thus, measurement of low-mass product ions can be simultaneously achieved with improvement of dissociation efficiency.

7 Claims, 4 Drawing Sheets

U.S. PATENT DOCUMENTS

| | | | | |
|---|---|---|---|---|
| 2004/0155183 | A1* | 8/2004 | Kawato | 250/292 |
| 2004/0232328 | A1* | 11/2004 | Ding et al. | 250/292 |
| 2006/0054808 | A1* | 3/2006 | Schwartz | 250/290 |
| 2007/0295903 | A1* | 12/2007 | Schwartz | 250/290 |

FOREIGN PATENT DOCUMENTS

| | | | |
|---|---|---|---|
| JP | 2005-78804 | A | 3/2005 |

OTHER PUBLICATIONS

Vladimir M. Doroshenko, et al, "Pulsed Gas Introduction for Increasing Peptide CID Efficiency in a Maldi/Quadrupole Ion Trap Mass Spectrometer", Analytical Chemisty, Feb. 1, 1996, pp. 463-472, vol. 68, No. 3.

* cited by examiner

MASS-ANALYSIS METHOD AND MASS-ANALYSIS APPARATUS

TECHNICAL FIELD

The present invention relates to a mass-analysis method and mass-analysis apparatus in which an ion to be analyzed is dissociated by collision-induced dissociation using an ion trap for confining ions by an electric field.

BACKGROUND ART

In the field of mass spectrometry, a technique called the MS/MS analysis (or tandem analysis) is widely known. Generally, an MS/MS analysis is conducted as follows: Initially, an ion having a specific mass-to-charge ratio (m/z) is selected from various kinds of ions generated from an object to be analyzed. Then, the selected ion, which is called the precursor ion, is dissociated into product ions by an appropriate process, e.g. collision-induced dissociation (CID). The product ions thus created are subjected to mass analysis to obtain information about the molecular structure of the objective ion. In the case of ion trap mass spectrometers, the CID process can take place within an ion trap having the function of confining ions.

The principle of ion selection by the ion trap mass spectrometer is now explained. Suppose a typical three-dimensional quadrupole ion trap is placed in a cylindrical coordinate system (r, Z), as shown in FIG. 2. This ion trap 1 includes a circular ring electrode 2, whose inner surface is in the form of a hyperboloid of revolution of one sheet, and a pair of end-cap electrodes 3 and 4 facing each other across the ring electrode 2, whose inner surfaces are in the form of a hyperboloid of revolution of two sheets. The space surrounded by these electrodes 2, 3 and 4 is the ion-trapping space 5. Now, suppose that an ion-capturing radio-frequency (RF) voltage $U-V\cos\Omega t$ (which may be simply called the "ion-capturing voltage" hereinafter) is applied to the ring electrode 2, as shown.

The motions of various kinds of ions within a quadrupole electric field created within the ion-trapping space 5 by applying the ion-capturing voltage can be described by the following independent equations of motions (1) and (2) for the Z and r directions, respectively:

$$d^2r/dt^2+(z/mr_0^2)(U-V\cos\Omega t)r=0 \quad (1)$$

$$d^2Z/dt^2+(2z/mr_0^2)(U-V\cos\Omega t)Z=0 \quad (2),$$

where m is the mass of the ion, z is the charge of the ion, and $r_0$ is the inscribed circle diameter of the ring electrode 2. Now, let $a_z$, $a_r$, $q_z$, and $q_r$ be defined by the following equations (3) and (4):

$$a_z=-2a_r=-8U/[(m/z)r_0^2\Omega^2] \quad (3)$$

$$q_z=-2q_r=4V/[(m/z)r_0^2\Omega^2] \quad (4).$$

Then, the equations of motions (1) and (2) can be rewritten in the form of the following Mathieu equations (5) and (6):

$$d^2r/d\zeta^2+(a_r-2q_r\cos 2\zeta)r=0 \quad (5)$$

$$d^2Z/d\zeta^2+(a_z-2q_z\cos 2\zeta)Z=0 \quad (6),$$

where $\zeta=(\Omega t)/2$.

The natures of the solutions of these Mathieu equations can be expressed using $a_z$ and $q_z$. FIG. 3 is a graph illustrating stability conditions of the solutions of the Mathieu equations, with $a_z$ as the coordinate and $q_z$ as the abscissa. The area S surrounded by the solid line on the $a_z$-$q_z$ plane in FIG. 3 gives the stability solutions of the previous equations. That is, for an ion with a mass-to-charge ratio m/z, the previous equations determine the parameters $a_z$ and $q_z$, and if the value pair ($a_z$, $q_z$) lies within a specific area, the ion will be captured within the ion-trapping space 5, continuing its oscillation at a specific frequency. Specifically, the stability area S defined by the solid line is the area where ions can stay within the ion-trapping space 5 in a stable manner, and the surrounding area is the instability area where ions will be dispersed.

If the direct-current component U of the ion-capturing voltage is zero, then $a_z=0$ on the $a_z$-$q_z$ plane in FIG. 3, which means that the q axis indicated by Q in FIG. 3 is the only condition to be considered. In the case of a conventional analogue ion trap (which is abbreviated as the "AIT" hereinafter) using a sinusoidal RF voltage as the ion-capturing voltage, the boundary of the stability area S is at $q_z=0.908$ (point P on the q axis). Therefore, any ion whose mass-to-charge ratio yields a $q_z$ value equal to or greater than 0.908 does not meet the trapping condition and cannot be captured. In equation (4), the mass-to-charge ratio m/z appears in the denominator, which means that any ion whose m/z is equal to or less than a specific value (called the "low mass cutoff" or LMC) will not be trapped. Theoretically, the value of LMC can be regulated by changing the amplitude V or frequency Ω of the RF component of the ion-capturing voltage. However, it is practically difficult for AITs to change the frequency Ω. Therefore, the amplitude V is usually changed to regulate the LMC value.

For a digital ion trap (DIT), in which a square-wave RF voltage is applied to the ring electrode 2 as the ion-capturing voltage, it is known that the theories applicable to the AIT also hold true, except that $q_z$ has a smaller value (0.7125) at the boundary of the stability area S (refer to Non-Patent Document 1 or other documents). In the DIT, the LMC value can be regulated at will by changing the frequency Ω of the ion-capturing voltage.

Under the previously described conditions, a CID reaction for dissociating the objective ion of a specific mass-to-charge ratio, which is trapped within the ion-trapping space 5, can be induced by applying to the end-cap electrodes 3 and 4 an RF voltage of frequency $\Omega_{ex}$ that resonates with the secular frequency $\Omega_s$ of the objective ion. The frequency $\Omega_{ex}$ is signified by the following equation (7):

$$\Omega_{ex}=\Omega_s=(1/2)\beta_z\Omega \quad (7),$$

where the parameter $\beta_z$ represents the Z-directional oscillation of the ion, as shown in FIG. 3. Ions are stable within the range $0<\beta_z<1$. The electric field created in the trap space 5 by the RF voltage causes resonant excitation of the objective ion, which collides with a rare gas. Thus, the objective ion is dissociated by CID into various product ions (fragment ions) having smaller mass-to-charge ratios than that of the objective ion.

When trapped in the ion-trapping space 5 as described previously, the ion senses a potential well created by the ion-capturing voltage. The depth $D_z$ of this well depends on the value of $q_z$ (which is called the "q-value" hereinafter). It is generally known that a larger q-value produces a deeper potential well, in which ions are accelerated to higher speeds by resonant excitation and gain more kinetic energy, so that the dissociation efficiency improves (refer to Non-Patent Document 2 or other documents). In other words, the dissociation efficiency can be improved by trapping the objective ion with the highest possible q-value. However, increasing the q-value also increases the LMC value and thereby makes it more difficult to trap product ions resulting from dissociation whose mass-to-charge ratios are smaller than the LMC value.

To determine the amino acid sequence of a protein by an MS/MS (or $MS^n$) analysis, it is also important to obtain information about product ions having small mass-to-charge ratios. In such cases, the analysis must be also performed with a smaller LMC value so as to cover small mass-to-charge ratios. To analyze such low-mass product ions, it is necessary to trap the objective ion with the lowest possible q-value, even through this operation deteriorates to some extent the dissociation efficiency. Thus, in setting the q-value, it is impossible to simultaneously satisfy the two requirements of improving the dissociation efficiency and decreasing the lower limit of the mass range (mass-to-charge ratio range) to be analyzed. Such a trade-off between the dissociation efficiency and the lower limit of the mass range has been conventionally taken into account in selecting a q-value for a dissociating operation.

Non-Patent Document 1: L. Ding et al., "A digital ion trap mass spectrometer coupled with atmospheric pressure ion sources", *J Mass Spectrom.,* 39 (2004), pp. 471-484

Non-Patent Document 2: V. M. Doroshenko et al., "Pulsed gas introduction for increasing peptide CID efficiency in a MALDI/quadrupole ion trap mass spectrometer", *Anal. Chem.,* 68 (1996), pp. 463-472

DISCLOSURE OF THE INVENTION

Problem to be Solved by the Invention

The present invention has been achieved to solve the previously described problem, an objective of which is to provide a mass-analysis method and mass-analysis apparatus which can achieve high levels of dissociation efficiency in dissociating an ion within an ion trap while maintaining the lower limit of the target mass range at low levels, thus simultaneously ensuring both a broad mass range and a high level of dissociation efficiency.

Means for Solving the Problem

To solve the aforementioned problem, a first aspect of the present invention provides a mass-analysis method for operating a mass-analysis apparatus with an ion trap for capturing ions by an electric field created within a space surrounded by a plurality of electrodes. The method, which includes the steps of holding ions within the ion trap, then dissociating a specific kind of ion into product ions, and subjecting the product ions to mass analysis, is characterized by:

a) a precursor ion selection step in which, among various kinds of ions captured within the ion trap, those ions whose mass-to-charge ratios are within a predetermined mass range including the mass-to-charge ratio of an objective ion are selectively maintained as precursor ions within the ion trap;

b) a high q-value-setting step in which the frequency of an ion-capturing radio-frequency voltage applied to at least one of the electrodes is regulated so that the objective ion will be captured with a relatively high q-value;

c) a dissociation-performing step in which an ion-exciting radio-frequency voltage for causing resonant excitation of the objective ion is applied to at least one of the electrodes in order to help collision-induced dissociation of the objective ion within the ion trap, and then the application of the ion-exciting radio-frequency voltage is discontinued within a period of time where at least a portion of the product ions generated by the collision-induced dissociation remain in the ion trap; and d) a product ion-capturing step in which the product ions are captured after the frequency of the ion-capturing radio-frequency voltage is changed so that the product ions will be captured with a relatively low q-value, simultaneously with discontinuation of the application of the ion-exciting radio-frequency voltage, or within a period of time where at least a portion of the product ions generated by the collision-induced dissociation remain in the ion trap after the discontinuation of the application of the ion-exciting radio-frequency voltage.

A second aspect of the present invention provides a mass-analysis apparatus for carrying out the mass-analysis method according to the first aspect of the present invention on a practical basis. The apparatus includes:

an ion trap including a plurality of electrodes and capturing ions by an electric field created within a space surrounded by the electrodes;

a voltage-applying section for applying a radio-frequency voltage to each of the electrodes;

a gas-introducing section for introducing a collision-induced-dissociation (CID) gas into the ion trap; and a controlling section for controlling the voltage-applying section and the gas-introducing section, and performs the operations of holding ions within the ion trap, then dissociating a specific kind of ion into product ions by collisions with the CID gas, and subjecting the product ions to mass analysis. This apparatus is characterized in that the controlling section:

operates the voltage-applying section to generate a radio-frequency voltage that causes unnecessary ions, among various kinds of ions captured within the ion trap, to be dispersed so that those ions whose mass-to-charge ratios are within a predetermined mass range including the mass range of an objective ion will be selectively maintained as precursor ions within the ion trap;

then sets the frequency of an ion-capturing radio-frequency voltage to be applied to at least one of the electrodes so that the objective ion will be captured with a relatively high q-value;

introduces the CID gas into the ion trap by the gas-introducing section, applies an ion-exciting radio-frequency voltage for causing resonant excitation of the objective ion to at least one of the electrodes in order to help collision-induced dissociation of the objective ion within the ion trap, and discontinues the application of the ion-exciting radio-frequency voltage within a period of time where at least a portion of the product ions generated by the collision-induced dissociation remain in the ion trap; and controls the voltage-applying section so as to change the frequency of the ion-capturing radio-frequency voltage so that the product ions will be captured with a relatively low q-value, simultaneously with discontinuation of the application of the ion-exciting radio-frequency voltage, or at a delayed point in time within a period of time where at least a portion of the product ions generated by the collision-induced dissociation remain in the ion trap after the discontinuation of the application of the ion-exciting radio-frequency voltage.

In the mass-analysis method and apparatus according to the first and second aspects of the present invention, introduction of the CID gas and resonant excitation of the objective ion to be dissociated by CID are carried out when the objective ion is trapped with a relatively high q-value, which helps the dissociation of the objective ion. At or immediately after the beginning of the dissociation process, the objective ion is dissociated with a high level of efficiency since the ion is trapped with a high q-value. However, maintaining the high q-value also means maintaining a high LMC value. Therefore, among various product ions generated by dissociation, those product ions whose mass-to-charge ratios are smaller than the LMC value will dissipate without being captured. To avoid this situation, the dissociating operation is terminated by discontinuing the ion-exciting radio-frequency voltage before the low-mass product ions are completely dissipated from the ion trap. Then, simultaneously, or at a delayed point in time where the product ions still remain in the ion trap, the frequency of the ion-capturing radio-frequency voltage is changed so that the q-value will be lowered.

This change in frequency lowers the q-value of the ion trap and also the LMC value. This condition makes it easier for ions having small mass-to-charge ratios to be captured, thus ensuring the capturing of the product ions (and the objective ion) remaining in the ion trap, including not only those ions having large mass-to-charge ratios but also those having small mass-to-charge ratios. The product ions thus assuredly captured are then separated according to their mass within the ion trap or by another mass analyzer provided outside the ion trap, and the objective ion and product ions are detected. Thus, the lower limit of the analyzable mass range for the product ions generated by dissociation within the ion trap is lowered, so that the product ions having small mass-to-charge ratios can be analyzed.

The change in the q-value of the ion trap is achieved by varying the frequency of the ion-capturing radio-frequency voltage; it is unnecessary to change the amplitude of the voltage. In the case of changing the q-value by varying the amplitude of the ion-capturing radio-frequency voltage, it will be necessary to increase the amplitude to achieve a higher q-value. However, this operation may undesirably cause an electric discharge within the ion trap, particularly when the mass-to-charge ratios of the ions to be analyzed are comparatively large, since in such a case the amplitude of the voltage must be considerably large to achieve a high q-value. On the other hand, changing the q-value by varying the frequency causes no electric discharge, so that the q-value can be set at any value.

In a preferable mode of the first and second aspects of the present invention, the voltage applied to each of the electrodes constituting the ion trap is a radio-frequency voltage generated by switching a direct-current voltage. In other words, the present invention is particularly effective if the ion trap is a DIT rather than an AIT.

For AITs, it is generally difficult to change the q-value by varying the frequency of the radio-frequency voltage. The reason is as follows: Due to the limitations of the power circuit used and other factors, AITs are designed so that they can produce a strong electric field even at low excitation voltages. This is typically achieved by increasing the Q-value of the resonance circuit system including the ion trap and its peripheral circuits. However, increasing the Q-value to improve the efficiency makes the Q-value more frequency-dependent and also deteriorates the time responsiveness of the system. The poor time responsiveness of the AIT circuit system impedes quick switching of the voltage frequency. On the other hand, in the case of DITs, which generate radio-frequency voltage by switching a DC voltage of a constant value, the frequency can be easily changed and its switching can be extremely quick.

An example of the ion trap is a so-called three-dimensional quadrupole ion trap, which includes a circular ring electrode and a pair of end-cap electrodes facing each other across the ring electrode. In this case, the ion-capturing radio-frequency voltage may be applied to the ring electrode and the ion-exciting radio-frequency voltage to the end-cap electrodes.

In a specific mode of the first and second aspects of the present invention, the relatively high q-value is within a range of $0.5 \leqq q < 1.0$, and the relatively low q-value is within a range of $0 < q \leqq 0.4$. These settings enable the capturing of an adequate amount of ions resulting from dissociation with small mass-to-charge ratios while ensuring an adequately high level of dissociation efficiency during the CID operation.

To discontinue the CID operation before the product ions generated by CID dissipate within the ion trap, the period of time for applying the voltage for causing the resonant excitation of ions for CID may be preferably set at an appropriate period of time equal to or shorter than 1 ms. In conventional CID operations, the period of time for applying the excitation voltage is typically 30 ms or longer. Compared to this value, the voltage-application time in the present invention is considerably short.

The delay time after the application of the voltage for causing the resonant excitation of ions is discontinued may be preferably within a range from 0 to 1 ms so that the product ions remaining in the ion trap at the completion of CID can be captured before they totally dissipate.

The ion-capturing efficiency is affected by the phase of the ion-capturing radio-frequency voltage at the point in time where the frequency of the voltage is changed so that the q-value will be lowered. Accordingly, a phase control for regulating the phase of the ion-capturing radio-frequency voltage at the moment of changing the frequency of the voltage may be preferably performed in order to achieve the highest possible ion-capturing efficiency.

Specifically, it is preferable to switch the frequency and thereby change the q-value at a point in time where the ions, which are oscillating within the ion trap under the influence of the electric field created by applying the ion-capturing radio-frequency voltage, are least influenced by the electric field. For the three-dimensional quadrupole ion trap, this is the point in time where the ions are located most distant from the ring electrode. In the case of positive ions, they are likely to be most distant from the ring electrode and reverse their moving direction at the midpoint of each period of time where the voltage applied to the ring electrode is negative (i.e. when the phase is around 270°). Accordingly, it is possible to switch the frequency when the phase is approximately 270°, while maintaining the phase continuity before and after the switching operation. It is not always possible to definitely determine the phase that gives the highest ion-capturing efficiency since the behavior of an ion changes depending on the polarity of the ion, the influence of the electric field created by the ion-exciting RF voltage, and other factors. However, in any case it is desirable to control the apparatus so that the phase is appropriately set when the frequency is switched. Such a phase adjustment will be relatively easy if a DIT is used.

Effect of the Invention

The mass-analysis method and apparatus according to the first and second aspects of the present invention can generate product ions with a high dissociation efficiency during the CID operation and assuredly capture the product ions within the ion trap while preventing the dissipation of product ions having small mass-to-charge ratios. Therefore, the lower limit of the analyzable mass range for product ions can be decreased so as to detect product ions having small mass-to-charge ratios with high sensitivity. The resulting mass spectrums will have clear peaks of the objective ion and various product ions, which improves the accuracy of identification or structural analysis of the objective substance.

BEST MODE FOR CARRYING OUT THE INVENTION

Figure 1:
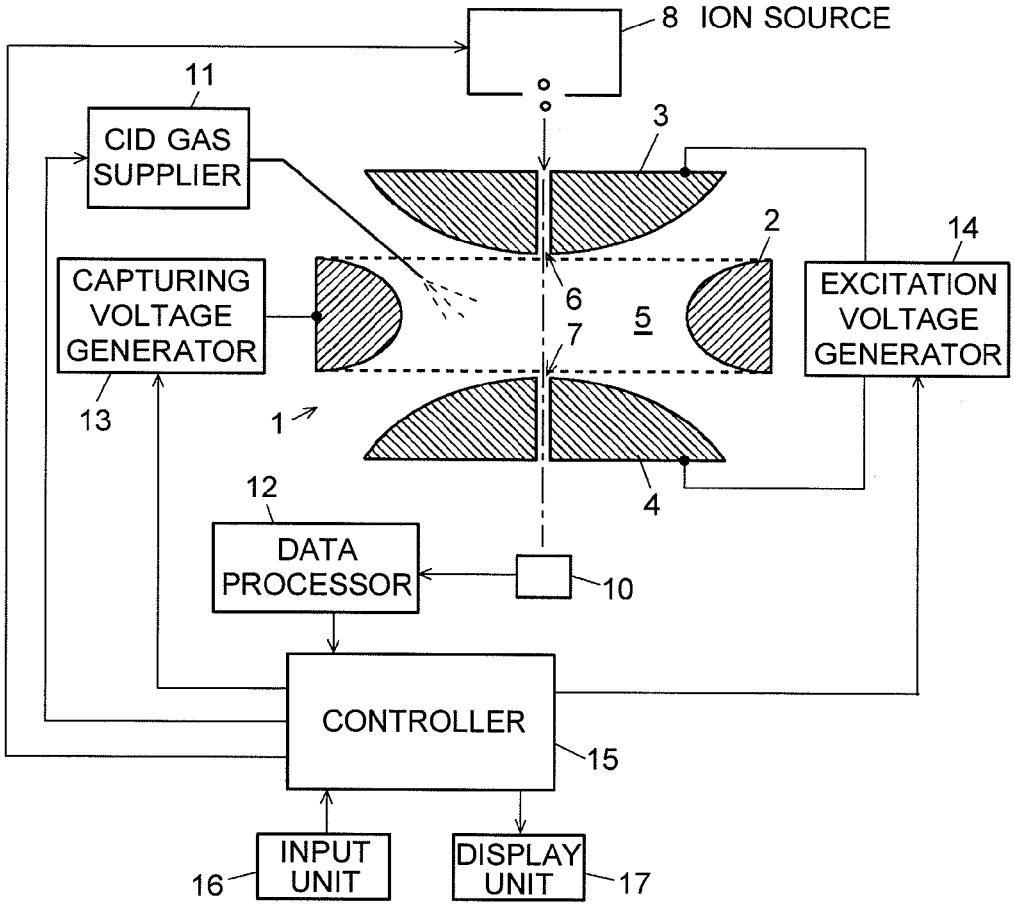
FIG. 1 is a general configuration diagram of an ion trap mass spectrometer according to an embodiment of the present invention.
Figure 2:
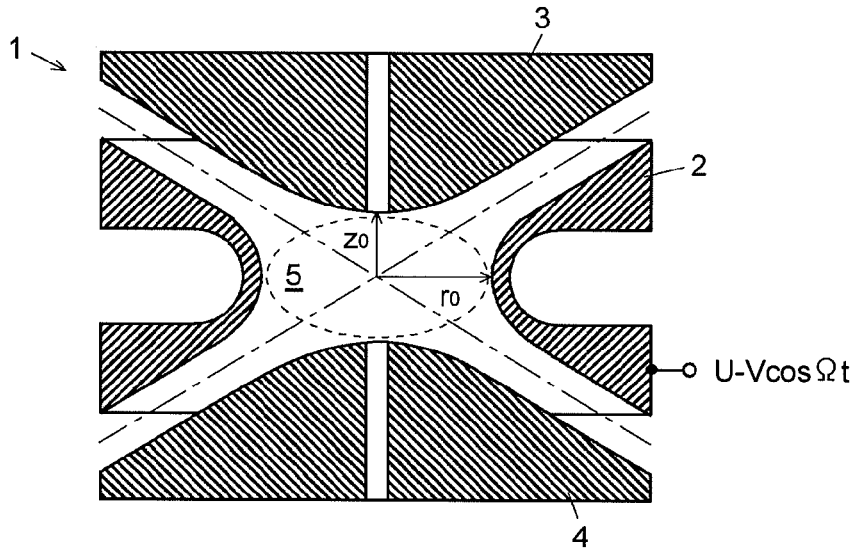
FIG. 2 is a configuration diagram of an ion trap placed in a cylindrical coordinate system (r, Z) for illustrating the principle of the mass-analysis apparatus according to the present invention.
Figure 3:
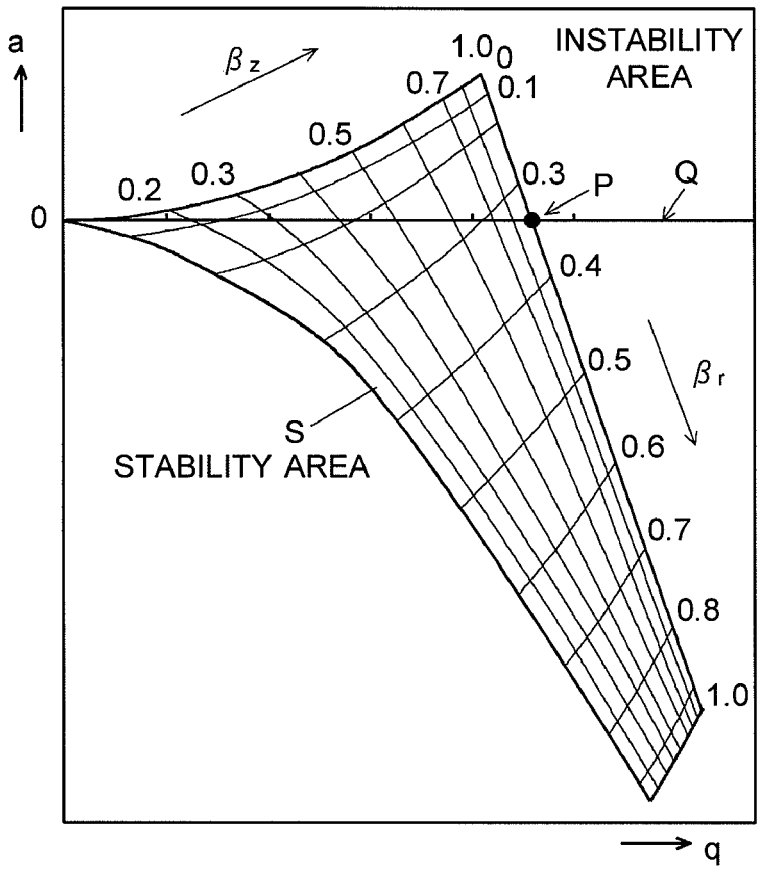
FIG. 3 is a chart for illustrating the stability of the operation of capturing ions in an ion trap.

This section details the structure and operation of an ion trap mass spectrometer (IT-MS) as an embodiment of the second aspect of the present invention for carrying out the mass-analysis method according to the first aspect of the present invention. FIG. 1 is a general configuration diagram of the IT-MS of the present embodiment. The components of the ion trap are denoted by the same numerals as already used in FIG. 2.

As explained previously, the ion trap 1 includes a ring electrode 2 and end-cap electrodes 3 and 4. The ring electrode 2 is connected with a capturing voltage generator 13, while the end-cap electrodes 3 and 4 are connected with an excitation voltage generator 14. An ion source 8 is located outside the injection port 6 formed approximately at the center of the inlet end-cap electrode 3. Molecular ions generated by the ion source 8 will be introduced through the injection port 6 into the ion-trapping space 5. The exit end-cap electrode 4 has an ejection port 7, which is approximately in alignment with the injection port 6. Located outside the ejection port 7 is an ion detector 10, which detects ions released from the ion-trapping space 5 through the ejection port 7 and sends detection signals indicative of the amount of the detected ions to the data processor 12. In this configuration, mass discrimination of the ions is performed within the ion trap 1, from which ions that have been separated according to their mass-to-charge ratios are ejected and then introduced into and detected by the ion detector 10. In the case of an IT-TOF configuration, in which a time-of-flight (TOF) mass analyzer (or other types of mass analyzers, such as a quadrupole mass filter) is provided between the ejection port 7 and the ion detector 10, the mass discrimination can be performed in the mass analyzer. The CID gas supplier 11, which is operated by a controller 15, supplies a rare gas, e.g. an argon (Ar) or helium (He) gas, into the ion trap 1 in order to cause CID within the ion trap 1.

Instead of producing ions outside the ion trap 1 and then introducing them into the trap 1, the apparatus may introduce sample molecules into the ion trap 1 and then ionize the molecules by, for example, irradiating them with thermo electrons.

The capturing voltage generator 13 and excitation voltage generator 14 are controlled so that each generator produces an RF (AC) voltage of a predetermined frequency and amplitude according to control signals fed from the controller 15. A DC voltage of a predetermined value is also added to each of the RF voltage when it is necessary. The ion trap 1 in the present embodiment is a digital ion trap (DIT); the RF voltage generation circuit in the capturing voltage generator 13 is the type of circuit that generates a square-wave RF voltage by switching a DC voltage of a predetermined value, and the switching frequency is controlled by the controller 15. The excitation voltage generator 14 may include an RF voltage generation circuit that generates a square-wave RF voltage, similar to the capturing voltage generator 13. Alternatively, it may use a circuit that generates a normal sinusoidal RF voltage.

The controller 15 includes a central processing unit (CPU), read-only memory (ROM), random access memory (RAM) and other components. It feeds control signals to the aforementioned sections on the basis of analysis conditions set through the input unit 16. The controller 15 also receives processed data from the data processor 12 and shows the analysis result (e.g. a mass spectrum) on the display unit 17.

To illustrate the operation of the IT-MS according to the present embodiment, an MS/MS mode analysis of an ion having a specific mass-to-charge ratio is described with reference to FIGS. 4 through 7. The following description deals with the case where the structure of reserpine, which is a kind of medicine (mass-to-charge ratio m/z=609), is determined by dissociating reserpine for mass analysis.

Figure 4:
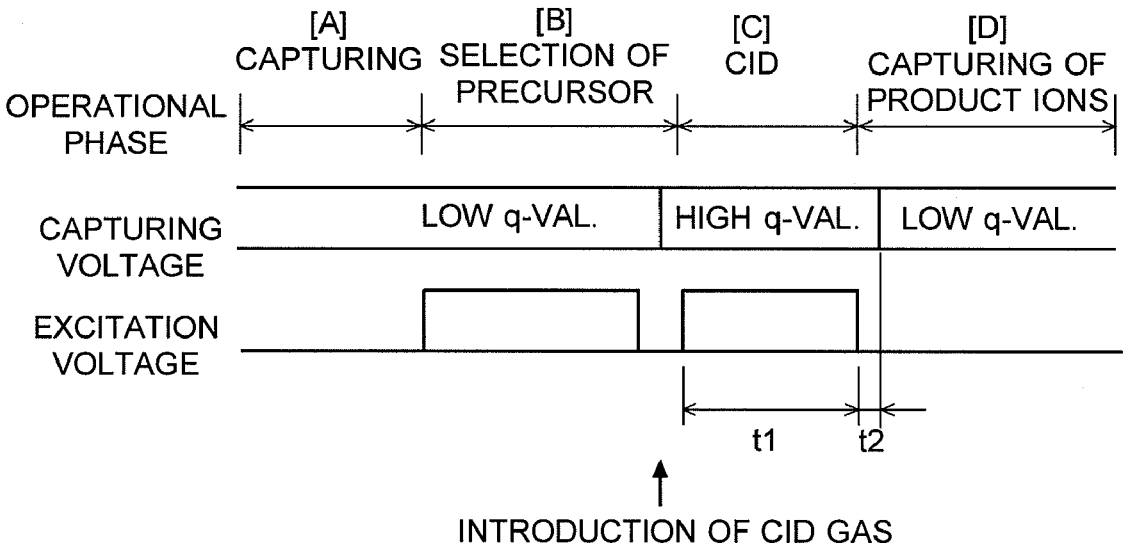
FIG. 4 is a timing chart for schematically illustrating an MS/MS analysis operation by the ion trap mass spectrometer according to the embodiment.
Figure 5:
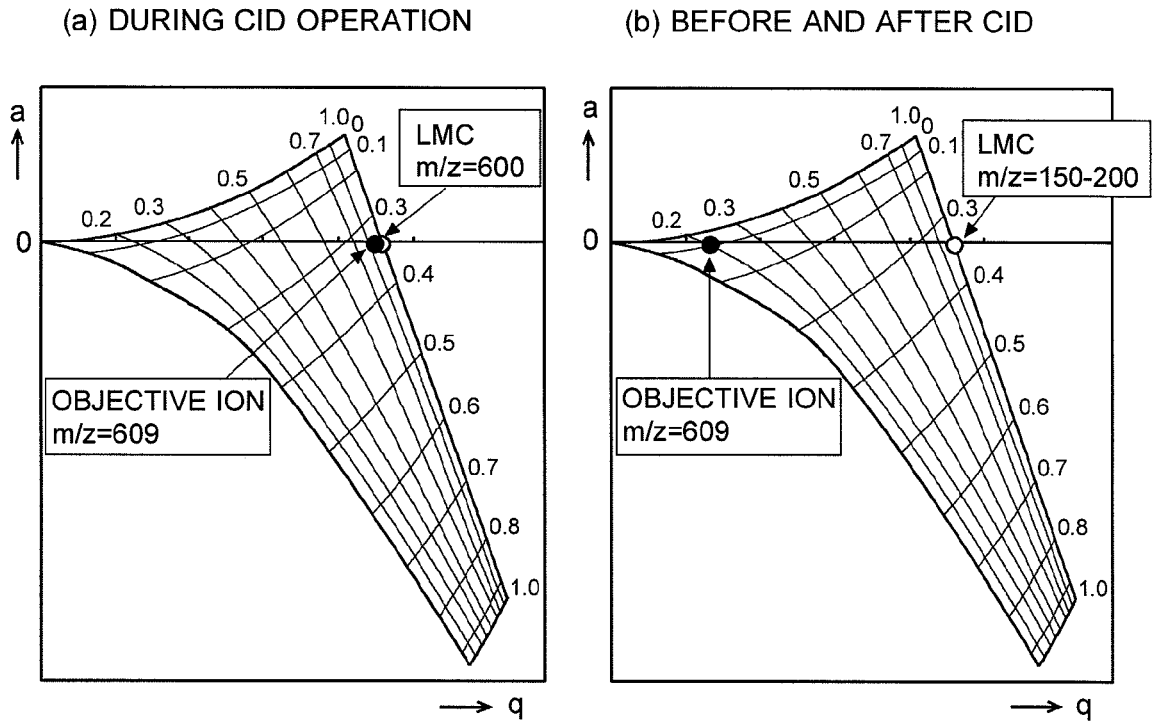
FIGS. 5(*a*) and (*b*) are charts for illustrating the stability of the operation of capturing ions during the MS/MS analysis operation by the ion trap mass spectrometer according to the embodiment.

After being introduced into the ion trap 1, the molecular ions to be analyzed are captured within the ion-trapping space 5 by an electric field created within the space 5 by the ion-trapping voltage applied from the capturing voltage generator 13 to the ring electrode 2 (phase [A] in FIG. 4). In this phase, it is desired that a broad mass range be observed. Therefore, the frequency of the ion-capturing RF voltage is selected to lower the q-value (which is 0.2 in the present example) so that the LMC will be adequately low, e.g. about 200. Under this condition, any ion whose mass-to-charge ratio is 200 or larger will be captured within the ion-trapping space 5. Therefore, miscellaneous ions that do not originate from the reserpine molecule can also stay in the ion-trapping space 5. This situation is shown in FIG. 5(*b*), where the objective ion is located distant from the boundary of the stability area S. In addition, ions whose mass-to-charge ratios are between 200 and 609 are also inside the stability area S and will be held within the ion-trapping space 5 in a stable manner.

Next, the operation of selecting precursor ions is performed so that only the ions of interest, i.e. those which have originated from the reserpine molecule, will selectively remain in the ion-trapping space 5 (phase [B] in FIG. 4). The selection of precursor ions can be achieved by conventional methods, such as the selected-waveform inverse Fourier transform (SWIFT) method or filtered noise field (FNF) method. For example, the FNF method generates a wideband excitation voltage having notches at the frequencies corresponding to the mass-to-charge ratios of the precursor ions and applies it between the two end-cap electrodes 3 and 4. This voltage causes the resonant excitation of ions, except for specific ions whose mass-to-charge ratios correspond to the notches. The ions excited will dissipate due to ejection from the ion trap 1 or collision with the electrodes 2, 3 and 4. As a result, only the precursor ions of interest, which have not been driven into resonant excitation, will remain in the ion-trapping space 5.

Subsequently, the dissociating operation by CID is carried out. For this operation, a CID gas, which consists of a rare gas, is initially supplied from the CID gas supplier 11 into the ion trap 1. Then, the frequency of the ion-capturing RF voltage is changed so that the objective ion, i.e. the reserpine molecule ion, will be captured with a high q-value (which is 0.7 in the present case). This is achieved by selecting a frequency that gives the largest possible LMC value (e.g. about 600) under the condition that it does not exceed the mass-to-charge ratio of the reserpine molecule ion. This situation is shown in FIG. 5(*a*), where the objective ion and LMC are in close proximity to each other. The reason for causing CID with the objective ion being captured with a high q-value is because a higher q-value leads to a higher dissociation efficiency. In this state, a CID operation is initiated (phase [C] in FIG. 4) by applying to the end-cap electrodes 3 and 4 an excitation voltage, composed of one or more frequency components, that resonates with the secular frequency of ions having a mass-to-charge ratio of 609. The electric field created within the ion-trapping space 5 by applying the excitation voltage causes ions having a mass-to-charge ratio of 609 to significantly oscillate, thus helping the ions to gain a considerable kinetic energy to collide with the CID gas. Thus, at least a portion of the ions will be dissociated by CID.

The mode of dissociation depends on the structure of the molecular ion; in the present case, many product ions obtained will have mass-to-charge ratios smaller than 600. The product ions thereby generated are relatively large in quantity since the dissociation efficiency is high due to the high q-value, as explained earlier. Meanwhile, the high q-value also increases the LMC value to approximately 600. As a result, the product ions generated by dissociation with mass-to-charge ratios smaller than 600 will be excluded from the stability area S shown in FIG. 5(*a*) and enter the instability area. Therefore, these product ions cannot be captured within the ion-trapping space 5; they will gradually dissipate due to ejection from the trap or collision with the electrodes 2, 3 and 4. Generally, the product ions are generated in large quantity immediately after CID is initiated, and then the rate of generation decreases with the lapse of time. Meanwhile, the rate of dissipation of the product ions increases with time. In most cases, a majority of product ions that have been abundantly produced remain in the ion-trapping space 5 at a point in time where approximately several hundreds μs have elapsed from the start of CID. Accordingly, the excitation voltage is turned off at that point in time to discontinue the CID operation. Then, simultaneously or at a delayed point in time, the frequency of the ion-capturing RF voltage is switched so that the q-value will be lowered (0.2 in the present case).

In FIG. 4, the period of time t1 for applying the excitation voltage (CID operation time) is, for example, within a range from 100 to 500 μs. The period of time t2 from the discontinuation of application of the excitation voltage to the switching of the q-value to the lower level may be preferably within a range from 0 to 100 μs. In normal CID processes using an ion trap, the period of time for applying the excitation voltage is rather long (approx. 30 ms), whereas the period of time in the present embodiment is much shorter, as stated earlier. Taking this into account, the amplitude of the excitation voltage may be preferably increased from a normal magnitude for CID operation (approx. 1 V) to a larger magnitude (e.g. approx. 20 V) so as to increase the kinetic energy given to the objective ion.

Switching the q-value after the completion of CID decreases the LMC value to, for example, approximately 150. The stability condition in the situation will be again as shown in FIG. 5(*b*), where the objective ion is inside the stability area S yet distant from the LMC. Miscellaneous ions having mass-to-charge ratios from 150 to 609 are also inside the stability area S; these ions can also stay in the ion-trapping space 5 in a stable manner. Thus, most of the ions present within the ion-trapping space 5 immediately before the q-value is switched, including product ions having mass-to-charge ratios equal to or larger than 150 as well as the original precursor ions, will be captured and held within the ion-trapping space 5 (phase [D] in FIG. 4). Subsequently, mass discrimination is carried out by scanning the excitation voltage applied to the end-cap electrodes 3 and 4 so that the mass-to-charge ratios of ions to be ejected from the ejection port 7 will be scanned one after another. The ions that have been ejected through the ejection port 7 will be sequentially detected by the detector 10.

In the ion detector 10, the objective ion having a mass-to-charge ratio of 609 and product ions having smaller mass-to-charge ratios generated from the objective ion by CID are detected with high sensitivity. Accordingly, a mass spectrum created by the data processor 12 will have clear peaks corresponding to these ions. These peaks facilitate the structural analysis based on the mass spectrum.

Figure 6:
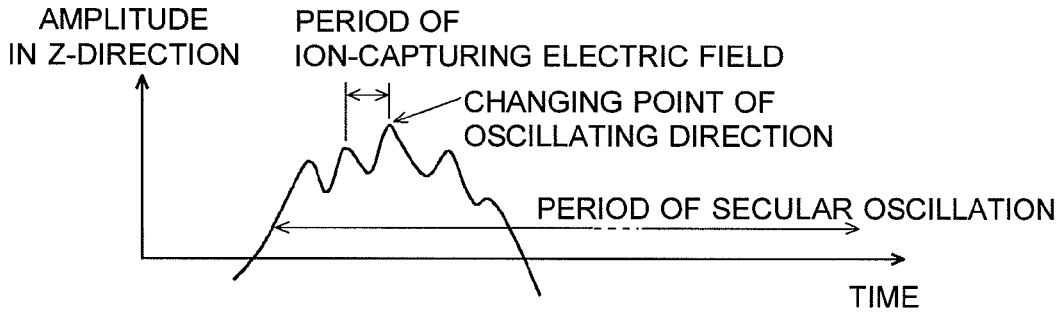
FIG. 6 is a chart for illustrating the behavior of an ion in an ion trap.

The IT-MS according to the present embodiment changes the q-value of the ion trap 1 by switching the frequency of the ion-capturing RF voltage, as described earlier. To improve the ion-capturing efficiency, it is important to consider the phase of the RF voltage, particularly when the frequency of the RF voltage is switched so as to lower the q-value after the CID operation is completed. Since the change in the q-value causes a sudden change in the ion-capturing potential, the state of the ions at the moment of changing the q-value affects the ion-capturing efficiency. The behavior of an ion captured within the ion-trapping space 5 will be as shown in FIG. 6, in which a waveform having a very long, secular oscillation period that depends on the mass-to-charge ratio are superposed on another waveform created by the ion-capturing electric field having a much shorter oscillation period. The coordinate axis in FIG. 6 indicates the position in the Z-direction. Accordingly, a larger value on the Z-axis can be interpreted as indicating a larger distance from the ring electrode 2. An ion located more distant from the ring electrode 2 should be less influenced by the ion-capturing electric field. Switching the frequency of the capturing voltage in such a situation will less disturb the ions in their behavior.

In the waveform created by the ion-capturing electric field, the positive peak is located at a point in time where an ion moving away from the center of the ion-trapping space 5 reverses its direction and starts moving toward the center. If the ion is positive, the reversal of the moving direction ideally takes places at the midpoint of the period of time where the voltage applied to the ring electrode 2 is negative, i.e. when the phase is 270°. Switching the q-value (i.e. changing the frequency) at this moment minimizes the influence on the ion and enables a comparatively stable transition of the ion-capturing conditions.

Figure 7:
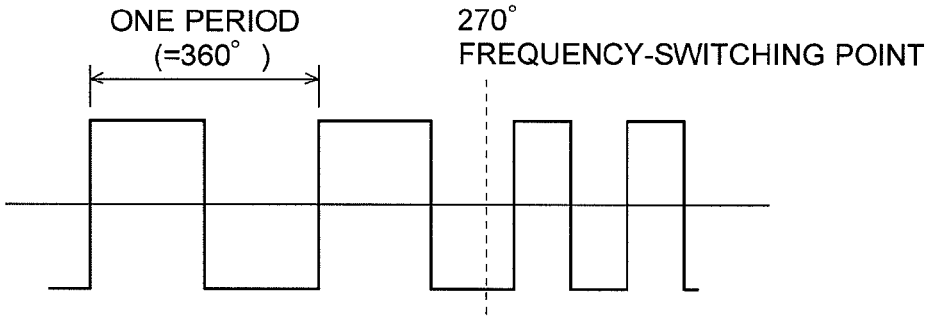
FIG. 7 is a chart for illustrating a method of switching the frequency of the ion-capturing voltage at the moment of changing the q-value.

Unlike AITs, DITs allow the phase to be simply adjusted by changing the timing of switching a DC voltage. The aforementioned operation of switching the frequency should be performed as shown in FIG. 7. That is, the frequency should be changed when the phase of the square-wave ion-trapping RF voltage is 270° within a single period, and the phase continuity should be maintained before and after the switching operation. This means that the waveform of the RF voltage after the frequency-switching operation starts with an initial phase of 270°.

However, the relationship between the phase of the ion-capturing RF voltage and the behavior of the ion changes depending on the polarity of the ion, the influence of the excitation electric field immediately before the frequency change, and other various factors. Accordingly, it is desirable to determine the best timing by attempting to adjust the phase at the moment of changing the frequency so as to achieve the highest possible ion-capturing efficiency.

Since the previous embodiment is a mere example, the numerical values used therein can be appropriately changed within the spirit and scope of the present invention. That is, the LMC values before, during and after the CID operation can be appropriately selected according to the mass-to-charge ratio of the objective ion. It is also obvious that other changes, modifications or additions can be optionally made to the previous embodiment.

Figure 8:
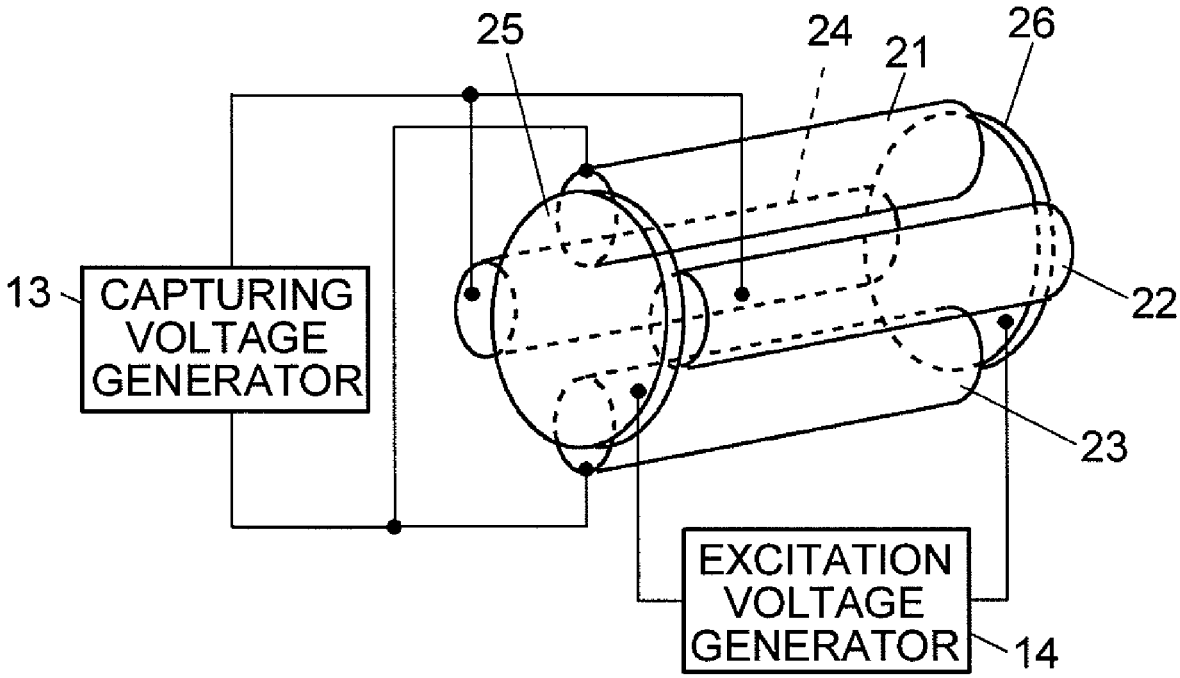
FIG. 8 is a configuration diagram of an ion trap according to another embodiment of the present invention.

For example, the configuration of the ion trap 1 may be entirely changed. FIG. 8 shows an example of the ion trap 1 having a different configuration. This ion trap 1 includes four rod electrodes 21, 22, 23 and 24, each having a hyperboloidal inner surface, and a pair of disk-shaped end-cap electrodes 25 and 26. The rod electrodes 21, 22, 23 and 24, which are replacements for the ring electrode 2, are arranged parallel to each other and in contact with an inscribed circle. The end-cap electrodes 25 and 26 are parallel to each other and close both ends of an axially extending space surrounded by the rod electrodes 21, 22, 23 and 24. Two rod electrodes (21 and 23, or 22 and 24) opposing each other are connected with each other. Any pair of rod electrodes neighboring each other in the circumferential direction are supplied with RF voltages having inverted phases, on which a common DC voltage is superposed.

When an ion is introduced into the space surrounded by the four rod electrodes 21, 22, 23 and 24, the ion will be captured within the space by the confining effect of the RF voltages in the radial direction and that of the DC electric field in the axial direction. Introducing a CID gas into this space and applying to the end-cap electrodes 25 and 26 an excitation voltage that resonates with the oscillating frequency of the ion in the axial direction will cause the ion to be dissociated by CID, as in the case of the three-dimensional quadrupole configuration. Subsequently, a technique similar to the previous embodiment can be applied.

The invention claimed is:

1. A mass-analysis method for operating a mass-analysis apparatus with an ion trap for capturing ions by an electric field created within a space surrounded by a plurality of electrodes, including steps of holding ions within the ion trap, then dissociating a specific kind of ion into product ions, and subjecting the product ions to mass analysis, characterized by:

a) a precursor ion selection step in which, among various kinds of ions captured within the ion trap, those ions whose mass-to-charge ratios are within a predetermined mass range including a mass-to-charge ratio of an objective ion are selectively maintained as precursor ions within the ion trap;

b) a high q-value-setting step in which a frequency of an ion-capturing radio-frequency voltage applied to at least one of the electrodes is regulated so that the objective ion will be captured with a relatively high q-value;

c) a dissociation-performing step in which an ion-exciting radio-frequency voltage for causing resonant excitation of the objective ion is applied to at least one of the electrodes in order to help collision-induced dissociation of the objective ion within the ion trap, and then application of the ion-exciting radio-frequency voltage is discontinued within a period of time where at least a portion of the product ions generated by the collision-induced dissociation remain in the ion trap; and d) a product ion-capturing step in which the product ions are captured after the frequency of the ion-capturing radio-frequency voltage is changed so that the product ions will be captured with a relatively low q-value, simultaneously with discontinuation of the application of the ion-exciting radio-frequency voltage, or at a delayed point in time within a period of time where at least a portion of the product ions generated by the collision-induced dissociation remain in the ion trap after the discontinuation of the application of the ion-exciting radio-frequency voltage;

wherein at least the ion-capturing radio-frequency voltage is a radio-frequency voltage generated by switching a direct-current voltage.

2. The mass-analysis method according to claim 1, wherein the ion trap comprises a circular ring electrode and a pair of end-cap electrodes facing each other across the ring electrode.

3. The mass-analysis method according to claim 1, wherein the relatively high q-value is within a range of $0.5 \leqq q < 1.0$.

4. The mass-analysis method according to claim 3, wherein the relatively low q-value is within a range of $0 < q \leqq 0.4$.

5. The mass-analysis method according to claim 1, wherein a period of time for applying the ion-exciting radio-frequency voltage for causing the collision-induced dissociation is equal to or shorter than 1 ms.

6. The mass-analysis method according to claim 5, wherein the delayed point in time is within a range from 0 to 1 ms after the application of the voltage for causing the resonant excitation of ions is discontinued.

7. The mass-analysis method according to claim 1, wherein a phase control for regulating a phase of the ion-capturing radio-frequency voltage at a moment of changing the frequency of the voltage is performed.

* * * * *